US009233563B1

(12) United States Patent
LeFevre et al.

(10) Patent No.: US 9,233,563 B1
(45) Date of Patent: Jan. 12, 2016

(54) IN-SITU NIP MEASUREMENT FOR PRINTING

(71) Applicant: XEROX CORPORATION, Norwalk, CT (US)

(72) Inventors: Jason M. LeFevre, Penfield, NY (US); Michael J. Levy, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/606,260

(22) Filed: Jan. 27, 2015

(51) Int. Cl.
*B41J 2/01* (2006.01)
*B41J 13/00* (2006.01)

(52) U.S. Cl.
CPC ..... *B41J 13/0027* (2013.01)

(58) Field of Classification Search
CPC ..... B41J 13/025; B41J 11/42; B41J 29/393; B41J 29/38; B41J 2/1224; B41J 2202/09; B41M 5/52
USPC ..... 347/16, 101, 103–105, 107
See application file for complete search history.

(56) References Cited

U.S. PATENT DOCUMENTS

| | | | | |
|---|---|---|---|---|
| 6,494,570 | B1 * | 12/2002 | Snyder | 347/103 |
| 8,641,163 | B2 * | 2/2014 | Williams et al. | 347/17 |
| 2014/0035984 | A1 * | 2/2014 | Mills et al. | 347/16 |
| 2014/0056606 | A1 * | 2/2014 | Hasegawa et al. | 399/67 |

* cited by examiner

*Primary Examiner* — Julian Huffman
*Assistant Examiner* — Sharon A Polk
(74) *Attorney, Agent, or Firm* — Ronald E. Prass, Jr.; Prass LLP

(57) ABSTRACT

A method for evaluating a nip condition in a printer is provided. The method includes printing a print area with a uniform density of marking material on a substrate; moving the substrate along a process direction into a spreading position in a nip while the nip is in an open position; stopping movement of the substrate along the process direction while the substrate is in the nip in the open position; closing the nip where the nip exerts pressure on a spread portion of the print area and the substrate such that the spread portion is visibly different from a remainder of the print area outside of the spread portion; opening the nip; moving the substrate away from the spreading position and out of the nip; and analyzing the spread portion relative to the remainder of the print area to determine characteristics of the nip condition.

17 Claims, 7 Drawing Sheets

IN-SITU NIP MEASUREMENT FOR PRINTING

BACKGROUND

Disclosed herein is a system and method for measuring the nip in an image forming apparatus.

Embodiments of the disclosure are well suited for measuring the nip in a printer.

SUMMARY

Some image forming devices use a nip, for example between two rolls, to apply pressure to an image formed on a sheet of media. Characteristics, for example nip width, symmetry, and uniformity, of the nip are important to the quality of the image. Particular methods exist for measuring the characteristics of the nip. However, these methods can be dangerous due to operator proximity to the nip and very expensive due to the cost of the materials used.

Embodiments of the disclosure provide safe and cost effective systems and methods of measuring the nip using normal sheet media and the marking material used by the image forming device in normal operation.

An embodiment of the disclosure may include a method for evaluating a nip condition in a printing apparatus, the method including printing with the printing apparatus a print area with a uniform density of marking material on a substrate; moving the substrate along a process direction into a spreading position in a nip while the nip is in a first open position; stopping movement of the substrate along the process direction while the substrate is in the nip in the open position; closing the nip to a closed position where the nip exerts pressure on a spread portion of the print area and the substrate such that the spread portion is visibly different from a remainder of the print area outside of the spread portion; opening the nip to a second open position; moving the substrate away from the spreading position and out of the nip; and analyzing the spread portion relative to the remainder of the print area to determine characteristics of the nip condition.

Another embodiment of the disclosure may include a method for evaluating a nip condition in a solid-ink jet printer, the method including printing with the printer a 100 percent solid fill print area of solid ink on a sheet of paper, the paper being paper used for normal printing in the printer; moving the sheet of paper along a process direction into a spreading position in a nip while the nip is in an open position; stopping movement of the sheet of paper along the process direction while the sheet of paper is in the nip in the open position; closing the nip to a closed position where the nip exerts pressure on a spread portion of the print area and the sheet of paper such that the spread portion is visibly different from a remainder of the print area outside of the spread portion; opening the nip to the open position; moving the sheet of paper away from the spreading position and out of the nip; and analyzing the spread portion relative to the remainder of the print area to determine characteristics of the nip condition.

Another embodiment of the disclosure may include a printing apparatus configured to produce a print area for evaluating a nip condition of the printing apparatus, the apparatus including a substrate path configured to move a substrate; an image forming portion configured to form the print area on the substrate; a nip configured to exert pressure on the print area and the substrate; and a controller that controls the substrate path, the image forming portion, and the nip such that the image forming portion prints the print area with a uniform density of marking material on the substrate, the substrate is moved along the path in a process direction into a spreading position in the nip while the nip is in a first open position, movement of the substrate is stopped along the process direction while the substrate is in the nip in the open position, the nip is closed to a closed position where the nip exerts pressure on a spread portion of the print area and the substrate such that the spread portion is visibly different from a remainder of the print area outside of the spread portion, the nip is opened to a second open position, and the substrate is moved along the path away from the spreading position and out of the nip.

DETAILED DESCRIPTION

Figure 1:
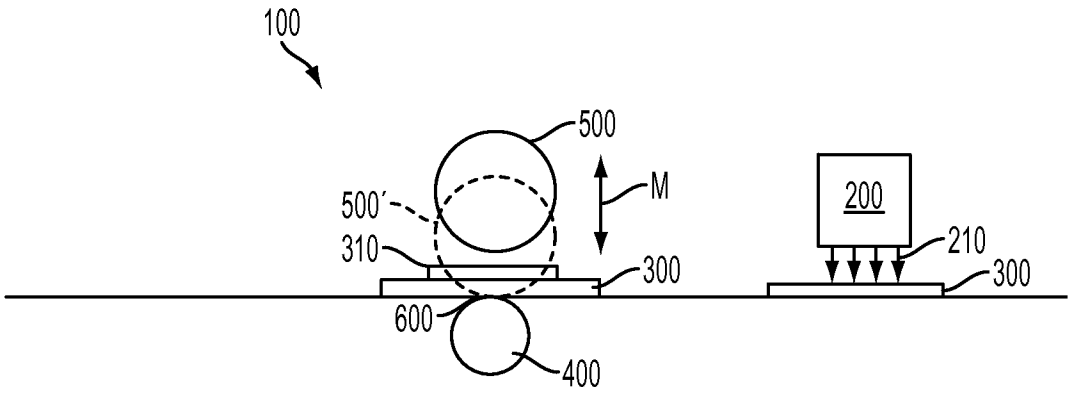
FIG. 1 is a schematic view of an image forming apparatus in accordance with embodiments of the disclosure.

The disclosed embodiments may include an image forming device that forms an image on a piece of media. For example, a printer such as a solid-ink direct-to-paper ink jet printer. Such a device can form an image on a substrate using a jetted ink process followed by subjecting the image and the substrate to pressure. In such image forming devices, the pressure can be applied between two rolls, in particular, at a nip between the two rolls. In order to provide the desired quality of the printed image, it is important that the characteristics of the nip be maintained within acceptable standards. Such characteristics can include, but are not limited to, nip width, symmetry and uniformity.

Some methods for measuring the characteristics of the nip involve the use of expensive single-use sheets of film and manual placement of such film in the nip. Apart from the expense associated with these films, an operator having to have his or her hands in and around the high pressure nip (which can be on the order of 6000 pounds of pressure) can pose a serious safety concern. In addition, the location of the nip can be such that it is difficult to access.

Embodiments of the disclosure propose using a solid-fill image printed on media in the marking engine of the printer to be used as the medium on which a nip impression can be made. These embodiments avoid having to gain access to the nip, the operator placing his or her hands in and around the nip, and the use of expensive films.

The disclosed embodiments may include a method for evaluating a nip condition in a printing apparatus, the method including printing with the printing apparatus a print area with a uniform density of marking material on a substrate; moving the substrate along a process direction into a spreading position in a nip while the nip is in a first open position; stopping movement of the substrate along the process direction while the substrate is in the nip in the open position; closing the nip to a closed position where the nip exerts pressure on a spread portion of the print area and the substrate such that the spread portion is visibly different from a remainder of the print area outside of the spread portion; opening the nip to a second open position; moving the substrate away from the spreading position and out of the nip; and analyzing the spread portion relative to the remainder of the print area to determine characteristics of the nip condition.

Other disclosed embodiments may include a method for evaluating a nip condition in a solid-ink jet printer, the method including printing with the printer a 100 percent solid fill print area of solid ink on a sheet of paper, the paper being paper used for normal printing in the printer; moving the sheet of paper along a process direction into a spreading position in a nip while the nip is in an open position; stopping movement of the sheet of paper along the process direction while the sheet of paper is in the nip in the open position; closing the nip to a closed position where the nip exerts pressure on a spread portion of the print area and the sheet of paper such that the spread portion is visibly different from a remainder of the print area outside of the spread portion; opening the nip to the open position; moving the sheet of paper away from the spreading position and out of the nip; and analyzing the spread portion relative to the remainder of the print area to determine characteristics of the nip condition.

Other disclosed embodiments may include a printing apparatus configured to produce a print area for evaluating a nip condition of the printing apparatus, the apparatus including a substrate path configured to move a substrate; an image forming portion configured to form the print area on the substrate; a nip configured to exert pressure on the print area and the substrate; and a controller that controls the substrate path, the image forming portion, and the nip such that the image forming portion prints the print area with a uniform density of marking material on the substrate, the substrate is moved along the path in a process direction into a spreading position in the nip while the nip is in a first open position, movement of the substrate is stopped along the process direction while the substrate is in the nip in the open position, the nip is closed to a closed position where the nip exerts pressure on a spread portion of the print area and the substrate such that the spread portion is visibly different from a remainder of the print area outside of the spread portion, the nip is opened to a second open position, and the substrate is moved along the path away from the spreading position and out of the nip.

FIG. 1 shows an example of a printer performing embodiments of the disclosure. In FIG. 1, and image forming apparatus 100 includes a print head array 200 that jets ink onto a sheet of media 300 to create an image 310. Media 300 is then moved by the image forming apparatus to a location between a pressure roll 400 and a spreader drum 500 (nip 600) while pressure roll and spreader drum 500 are separated. Media 300 is stopped at a position where image 310 is centered, or substantially centered, in nip 600. In this position, while media 300 is stationary, pressure roll 400 and spreader drum 500 are brought together into the nip position that is used during normal printing. This position is indicated in FIG. 1 by the dashed line 500'. This coming together of pressure roll 400 and spreader drum 500 creates an impression in image 310. After the impression is made in image 310, pressure roll 400 and spreader drum 500 are separated (as indicated by arrow M), and media 300 is moved out of the nip by the normal media movement system of the image forming apparatus. The image including the impression can then be analyzed to determine the characteristics of the nip.

Figure 2:
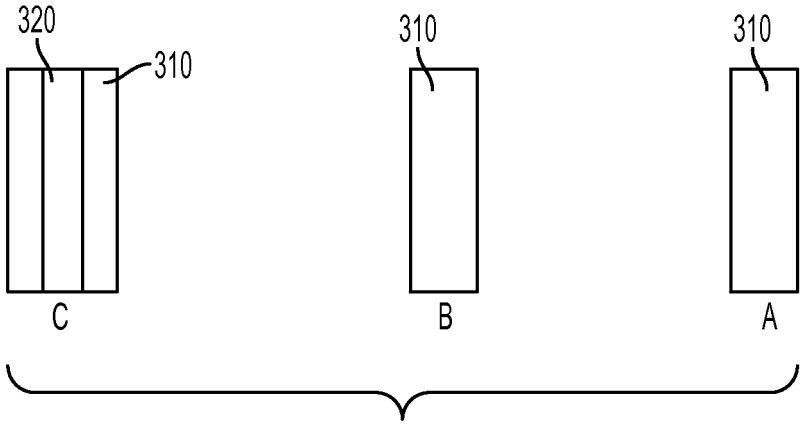
FIG. 2 shows an example of a progression of a piece of media in accordance with embodiments of the disclosure.

FIG. 2 is a top view of image 310 at various points in the process. At position A, image 310 is formed by print head array 200. At position B, image 310 is located in the nip but has not yet been subjected to pressure by pressure roll 400 and spreader drum 500. At position C, image 310 has been subjected to pressure by pressure roll 400 and spreader drum 500 to create impression 320.

In the examples shown in FIGS. 1 and 2, image 310 is shown as a rectangle. Image 310 can have other shapes as long as the portion of the nip desired to be measured is within the bounds of image 310, especially in the process direction. While various print densities can be used, particular embodiments use 100% fill print density. A dense fill can make the impression more distinct from the remaining parts of image 310 and thus easier to analyze. With particular marking material and media, the distinction between the impression and the remaining parts of image 310 can be a difference in gloss.

Many important nip metrics can be gathered from measuring the nip width, periodically along the length of the nip. This provides information about total nip load, nip load biasing, and nip symmetry and uniformity which are important metrics for assessing the nip during machine set-up and debugging.

In the examples shown in FIGS. 1 and 2, the media used can be a simple sheet of paper such as the paper normally used during printing.

Figure 3:
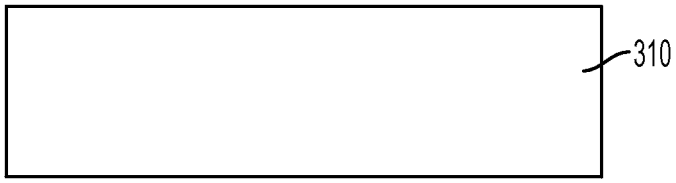
FIG. 3 shows an example of an image prior to spreading.
Figure 4:
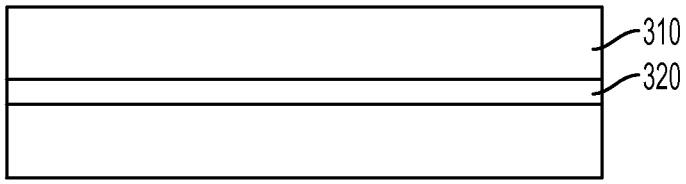
FIG. 4 shows an example of an image after spreading.

FIG. 3 shows image 310 before being subjected to pressure in the nip. FIG. 4 shows an example of an image 310 with an impression 320 that indicates a good symmetric nip condition. The parallel edges of impression 320 indicate that there is symmetrical and even pressure along the length of the nip.

Figure 5:
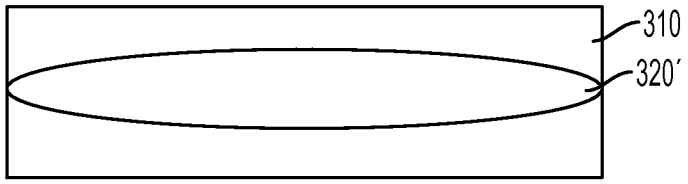
FIG. 5 shows an example of an image after spreading.
Figure 6:
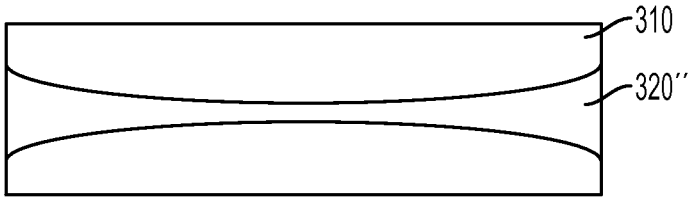
FIG. 6 shows an example of an image after spreading.

FIGS. 5 and 6 show examples of image 310 with impressions that indicate a symmetric but non-uniform nip condition, but slightly differing pressure along the length of the nip. The curved lines in FIGS. 5 and 6 are exaggerated to aid in the discussion, but in actuality the curves in the impression may be barely perceptible to the naked eye. In FIG. 5, impression 320' is larger in the process direction in the center of image 310 that it is at the ends of image 310. In FIG. 6, impression 320" is smaller in the process direction in the center of image 310 that is at the ends of image 310. As stated above, these curves in the impression indicate a different pressure along the length of the nip. Although the situations depicted in FIGS. 5 and 6 may not be as ideal as the situation depicted in FIG. 4, as long as these pressure differences are small, the situations depicted in FIGS. 5 and 6 may still be acceptable. Although the situation depicted in FIGS. 5 and 6 show pressure differences, they still indicate a symmetric pressure along the length of the nip.

Figure 7:
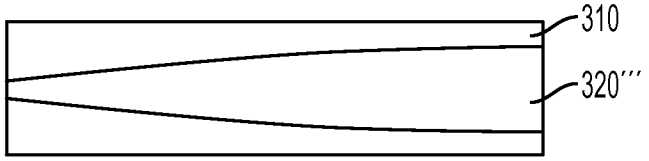
FIG. 7 shows an example of an image after spreading.
Figure 8:
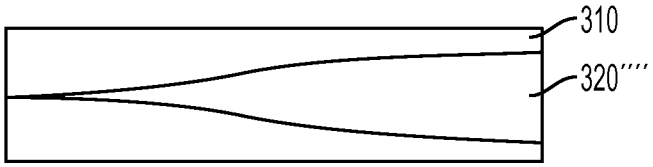
FIG. 8 shows an example of an image after spreading.

FIGS. 7 and 8 show examples of impressions that indicate non-symmetric and non-uniform pressure along the length of the nip. In FIG. 7, impression 320' is larger in the process direction at one end of the nip than it is at the other end of the nip. The situation is even more severe in the example shown in FIG. 8 where impression 320" comes to a point at one end of the nip. The situations depicted in FIGS. 7 and 8 indicate non-symmetric and non-uniform pressure along the length of the nip that can be caused by, for example, pressure roll 400 and spreader drum 500 not being parallel.

Figure 9:
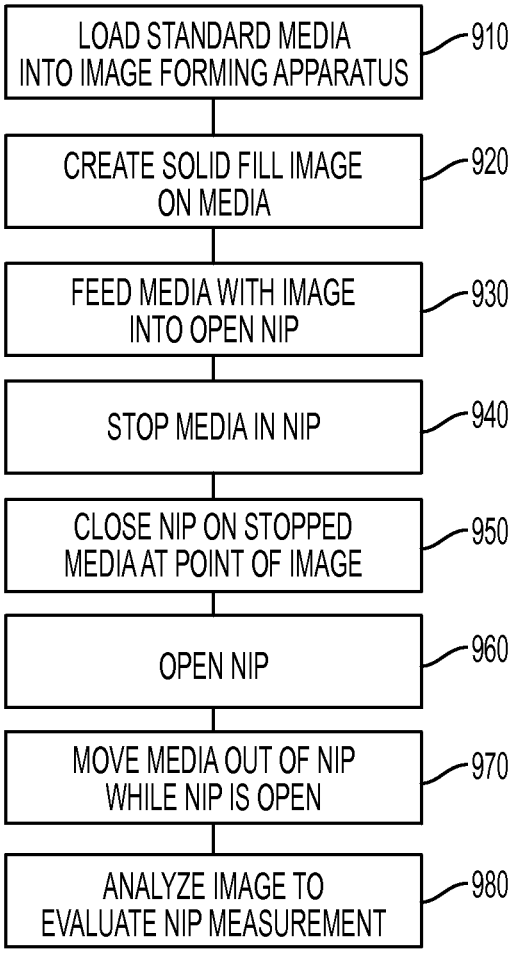
FIG. 9 shows an example of a method in accordance with embodiments of the disclosure.

FIG. 9 shows an example of a method in accordance with embodiments of the disclosure. In FIG. 9, at 910, standard media is loaded into the image forming apparatus. Any appropriate media can be used, however standard printing paper is appropriate and very inexpensive. In 920 a solid fill image is created on the media. In 930 media with the image is fed into the open nip. In 940 the media containing the image is stopped in the nip. In 950 the nip is closed on the stopped media at the point of the image such that the nip makes an impression on the image. In 960 the nip is opened. In 970 the media is moved out of the nip while the nip is open. In 980 the image is analyzed to evaluate the nip measurement. This analysis involves inspecting the nip impression on the image to determine if there is non-symmetric and/or non-uniform pressure along the length of the nip. The examples of impressions shown in FIGS. 4-8 are some examples of what a technician analyzing the impression may see. Based on what the technician sees in the impression, the nip can be adjusted and re tested until a satisfactory nip impression is obtained. As discussed above, an advantage of embodiments of the disclosure is that this retesting is done using common printer media (for example common paper) and is, as a result, very inexpensive compared to other methods of testing the nip.

Figure 10:
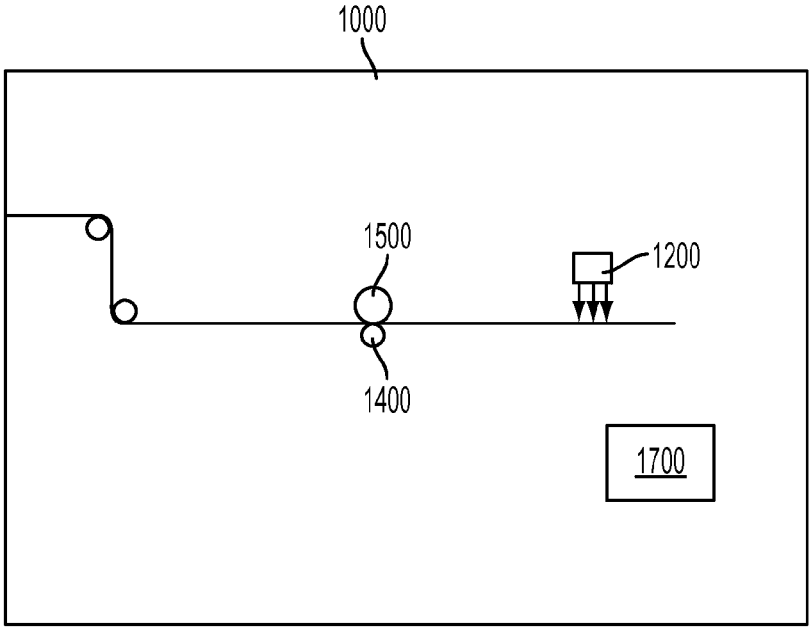
FIG. 10 is a schematic view of an image forming device in accordance with embodiments of the disclosure.

FIG. 10 shows an example of an image forming device 1000 that includes a print head array 1200 that jets ink onto a sheet of media. Image forming device 1000 also includes a pressure roll 1400 and a spreader drum 1500 that create a nip which exerts pressure on the image formed on the sheet of media. Image forming device 1000 also includes a controller 1700 that controls print head array 1200, pressure roll 1400, spreader drum 1500 and the movement of the sheet of media through image forming device 1000.

In particular embodiments, controller 1700 contains and/or runs a special program that controls the necessary parts of image forming device 1000 to perform methods in accordance with the disclosure. For example, controller 1700 contains and/or runs a special program that controls the necessary parts of image forming device 1000 in accordance with the method shown in FIG. 9. In other embodiments, the necessary parts of image forming device 1000 are manually operated to perform methods in accordance with the disclosure. For example, the necessary parts of image forming device 1000 are manually operated in accordance with the method shown in FIG. 9. In other embodiments, a combination of normal printer operation and manual operation is used.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A method for evaluating a nip condition in a printing apparatus, the method comprising:

printing with the printing apparatus a print area with a uniform density of marking material on a substrate;

moving the substrate along a process direction into a spreading position in a nip while the nip is in a first open position;

stopping movement of the substrate along the process direction while the substrate is in the nip in the open position;

closing the nip to a closed position where the nip exerts pressure on a spread portion of the print area and the substrate such that the spread portion is visibly different from a remainder of the print area outside of the spread portion;

opening the nip to a second open position;

moving the substrate away from the spreading position and out of the nip; and analyzing the spread portion relative to the remainder of the print area to determine characteristics of the nip condition, wherein one of the characteristics of the nip condition is a symmetry of the spread portion.

2. The method of claim 1, wherein one of the characteristics of the nip condition is a symmetry of the spread portion relative to a line that is perpendicular to the process direction.

3. The method of claim 2, wherein the substrate is paper used for normal printing in the printing apparatus.

4. The method of claim 3, wherein the printing apparatus is solid-ink jet printer.

5. The method of claim 4, wherein the print area is 100 percent solid fill.

6. The method of claim 5, wherein the nip is formed between a pressure roll and a spreader roll.

7. The method of claim 6, wherein the second open position and the first open position are the same.

8. The method of claim 1, wherein the analyzing includes measuring the symmetry of the spread portion to determine a symmetry of a pressure profile of the nip.

9. The method of claim 1, wherein the substrate is paper used for normal printing in the printing apparatus.

10. The method of claim 9, wherein the printing apparatus is solid-ink jet printer.

11. The method of claim 1, wherein the print area is 100 percent solid fill.

12. The method of claim 11, wherein the print area is a rectangle.

13. A method for evaluating a nip condition in a solid-ink jet printer, the method comprising:

printing with the printer a 100 percent solid fill print area of solid ink on a sheet of paper, the paper being paper used for normal printing in the printer;

moving the sheet of paper along a process direction into a spreading position in a nip while the nip is in an open position;

stopping movement of the sheet of paper along the process direction while the sheet of paper is in the nip in the open position;

closing the nip to a closed position where the nip exerts pressure on a spread portion of the print area and the sheet of paper such that the spread portion is visibly different from a remainder of the print area outside of the spread portion;

opening the nip to the open position;

moving the sheet of paper away from the spreading position and out of the nip; and analyzing the spread portion relative to the remainder of the print area to determine characteristics of the nip condition.

14. The method of claim 13, wherein the analyzing includes measuring the symmetry of the spread portion to determine a symmetry of a pressure profile of the nip.

15. The method of claim 14, wherein the print area is a rectangle.

16. A printing apparatus configured to produce a print area for evaluating a nip condition of the printing apparatus, the apparatus comprising:

a substrate path configured to move a substrate;

an image forming portion configured to form the print area on the substrate;

a nip configured to exert pressure on the print area and the substrate; and a controller that controls the substrate path, the image forming portion, and the nip such that the image forming portion prints the print area with a uniform density of marking material on the substrate, the substrate is moved along the path in a process direction into a spreading position in the nip while the nip is in a first open position, movement of the substrate is stopped along the process direction while the substrate is in the nip in the open position, the nip is closed to a closed position where the nip exerts pressure on a spread portion of the print area and the substrate such that the spread portion is visibly different from a remainder of the print area outside of the spread portion, the nip is opened to a second open position, and the substrate is moved along the path away from the spreading position and out of the nip, wherein the printing apparatus is solid-ink jet printer, and the print area is 100 percent solid fill.

17. The apparatus of claim 16, wherein the print area is a rectangle.

* * * * *